US007263789B2

(12) United States Patent
Hollinrake et al.

(10) Patent No.: US 7,263,789 B2
(45) Date of Patent: Sep. 4, 2007

(54) PLOW ASSEMBLY WITH ADJUSTABLE TRIP MECHANISM

(75) Inventors: Mark S. Hollinrake, Marion, IA (US); Mary T. Goos, Masonville, IA (US); Mike Voorhees, LaFargeville, NY (US); Lyle Seaman, Clayton, NY (US)

(73) Assignee: Henderson Manufacturing Company, Manchester, IA (US)

( * ) Notice: Subject to any disclaimer, the term of this patent is extended or adjusted under 35 U.S.C. 154(b) by 144 days.

(21) Appl. No.: 11/039,669

(22) Filed: Jan. 19, 2005

(65) Prior Publication Data

US 2005/0120594 A1 Jun. 9, 2005

Related U.S. Application Data

(63) Continuation of application No. 10/236,117, filed on Sep. 6, 2002, now Pat. No. 6,895,698.

(60) Provisional application No. 60/318,079, filed on Sep. 7, 2001.

(51) Int. Cl.
*E01H 5/04* (2006.01)

(52) U.S. Cl. ..... 37/231; 37/233; 37/271

(58) Field of Classification Search ..... 37/270, 37/271, 279, 266, 274, 407, 403, 232–235, 37/246; 172/264, 265, 261, 705
See application file for complete search history.

(56) References Cited

U.S. PATENT DOCUMENTS 2,103,775 A 12/1937 Frink
2,697,289 A 12/1954 Standfuss
3,626,614 A 12/1971 Kahlbacher
3,650,054 A 3/1972 Hanson
4,215,494 A 8/1980 Farrell et al.
5,109,618 A 5/1992 Grobler et al.
5,121,562 A 6/1992 Feller
5,191,729 A 3/1993 Verseef
5,437,113 A 8/1995 Jones
6,073,371 A 6/2000 Goos et al.
6,594,923 B1 * 7/2003 Kost et al. ..... 37/231
6,701,646 B2 * 3/2004 Schultz et al. ..... 37/232
6,895,698 B2 * 5/2005 Hollinrake et al. ..... 37/231

* cited by examiner

*Primary Examiner*—Thomas A Beach
(74) *Attorney, Agent, or Firm*—Leydig, Voit & Mayer, Ltd.

(57) ABSTRACT

A plow for mounting to a vehicle is disclosed. The plow can include a moldboard having a movable cutting edge and an adjustable bias trip mechanism having a biasing member preferably in the form of a spring. The adjustable trip mechanism can be arranged with the cutting edge of the moldboard to urge the cutting edge to a plowing position. The spring can be cooperatively arranged with a retainer, a pin for example, at one or more retaining positions to impart a preload biasing force upon the spring that varies according to the retaining position selected. The preload biasing force can act as a trip resistance force which must be overcome before the cutting edge moves. A lever tool can be provided for adjusting the spring.

22 Claims, 10 Drawing Sheets

PLOW ASSEMBLY WITH ADJUSTABLE TRIP MECHANISM

CROSS-REFERENCE TO RELATED PATENT APPLICATIONS

This patent application is a continuation of U.S. patent application Ser. No. 10/236,117, filed Sep. 6, 2002 now U.S. Pat. No. 6,895,698, which claims the benefit under 35 USC 119(e) of U.S. Provisional Patent Application No. 60/318,079, filed Sep. 7, 2001, and is entitled "Plow Assembly With Adjustable Trip Mechanism." The contents of U.S. patent application Ser. No. 10/236,117, filed Sep. 6, 2002 and U.S. Provisional Patent Application No. 60/318,079, filed Sep. 7, 2001, are incorporated herein in their entireties by this reference.

FIELD OF THE INVENTION

The present invention relates generally to a plow assembly and more particularly to a plow assembly including a trip mechanism for allowing the plow assembly to move in response to encountering an obstruction.

BACKGROUND OF THE INVENTION

Snowplow assemblies are commonly mounted onto a variety of vehicles during winter months for efficiently removing snow from paths, sidewalks, roadways, and other areas. These assemblies commonly employ a blade or moldboard in a forward position. The moldboard is typically mounted onto a plow frame, with the plow frame in turn being mounted onto the front of the vehicle, or one of the sides of the vehicle where the plow is a "wing," or "benching," plow. As the vehicle moves forward, the moldboard contacts the snow to displace it to one or both sides of the moldboard, thereby clearing the snow from the surface over which the moldboard passes. Examples of conventional snowplow assemblies are provided in U.S. Pat. Nos. 4,215,494, 5,109,618, 5,121,562, and 5,191,727.

During the plowing of snow, the moldboard is typically positioned so that its lower edge contacts and slides along, or is held just above, the road or other surface being plowed. Of course, roads, driveways, parking lots and other surfaces may be irregular, and may further contain protruding rocks, curbs, man-hole covers, ice chunks, or other debris embedded therein. These irregularities potentially create problems. For example, when the lower edge of a moldboard strikes an irregularity or other immovable object, the force of the impact may damage the moldboard, the frame, or in some cases the vehicle itself.

In order to protect the moldboard, the frame assembly and the vehicle from damage during use, it is known to mount the moldboard, or the lower portion thereof, pivotally so that the moldboard (or lower portion thereof) can "trip," or move, to avoid fully receiving the impact momentum energy developed when it strikes a rigidly fixed or immovable object. The moldboard can trip to pass over the object to avoid any significant damage to the assembly, truck chassis, driver/operator, etc. After the moldboard passes the object, a biasing force, typically provided by a spring, biases the moldboard back into its normal plowing position.

A "full trip" moldboard version where the entire moldboard pivots in response to encountering an obstruction is shown and described in U.S. Pat. No. 6,073,371 to Goos et al., issued Jun. 13, 2000, for example. In a "cutting edge trip" moldboard version, the moldboard includes a discrete cutting edge portion that is pivotally attached to the remainder of the moldboard with only the cutting edge pivoting in response to encountering an obstruction. Operators often express a strong preference for one version over the other.

While various configurations have been employed for biasing a pivotable moldboard, the biasing force provided by many of these configurations cannot be adjusted and is, therefore, often not optimal for more than one set of operating conditions. This creates a problem when a vehicle is assigned to remove snow from a variety of surfaces and driving speeds, each having a different surface condition, or in changing environmental conditions.

Some snowplow assemblies are assembled with a large hydraulic press which imparts a "preload" bias force on the springs, i e., the spring is preloaded with a selected amount of spring potential energy. The removal and/or replacement of an installed spring having a preload force imparted thereon can be very dangerous.

In other cases, preloaded springs for use in snowplows have been shipped in a cage or a container. In the event that a preloaded spring develops a structural defect, such as a stress fracture, or breaks its packaging while being handled, the chance for a serious injury occurring can be very great.

While there exist some snow plow assemblies that do provide for some degree of adjustment of a biasing force, these assemblies can be complicated mechanically and not relatively easily and quickly adjustable by a vehicle operator after the vehicle leaves the garage. For example, threaded bolts are used to adjust the spring preload in some snowplow assemblies. In these assemblies, the preload tension imparted upon the moldboard is often adjusted by the movement of threaded bolts. Such adjustment can be difficult and slow because the bolts are susceptible to rusting which can make them hard to turn or can "freeze" the bolts in place. Furthermore, in some instances, the operator may feel it is necessary to remove the moldboard from the snowplow drive frame to improve the accessibility to the bolts, thereby increasing the time required for the adjustment process and making it less likely that such an adjustment would occur in the field. Often, it is desirable to change the preload force imparted upon the moldboard in the field, as road surface conditions vary, such as when the vehicle moves from a paved surface to an asphalt or gravel surface, for example.

Thus, there exists a need for a snowplow assembly that overcomes the aforesaid and other problems associated with existing assemblies. One such need is for a snowplow assembly which provides an easily-mounted and readily-adjustable trip mechanism. Another need is for a trip mechanism that can provide for safe installation and removal.

SUMMARY OF THE INVENTION

The present invention addresses the foregoing and other needs by providing a snowplow assembly for a vehicle which includes an adjustable-bias trip mechanism. The trip mechanism can be easily and safely installed, removed, and adjusted with a simple lever. The trip mechanism provides improved adjustment for a torsion spring trip edge snowplow. The new design provides for ready adjustment of the spring tripping force across a range of settings to allow the operator to adapt to multiple road conditions quickly, easily and safely.

The inventive trip mechanism allows the spring to be safely mounted onto, and removed from, the snowplow assembly with no preload bias force on the spring, i.e., with the spring in its unloaded, normal position such that the spring potential energy is at, or substantially close to, zero. By placing the spring in its unloaded position during installation and removal, safe handling of the spring is enhanced.

Once the spring is mounted to the snowplow assembly, the lever can move one of the free tail ends of the spring into any one of a plurality of positions which yield a corresponding plurality of preload bias forces. The biasing force can act as a trip edge resistance which must be overcome to move the cutting edge of the plow from the normal plowing position. Thus, the trip mechanism can be adjusted to match plowing conditions so that the cutting edge can efficiently plow without tripping too readily and can trip when it encounters an obstacle that can generate a sufficient impact to overcome the trip edge resistance to trip the cutting edge. The ability to vary the trip edge resistance allows the snowplow operator to adjust the snowplow to adapt to varying road and environmental conditions as they change.

The trip mechanism can be adjusted by the lever to increase or decrease the preload bias force on a torsion spring, thereby respectively increasing or decreasing the resistance of the cutting edge to trip when meeting obstructions on a road surface. A single snowplow operator can quickly, safely, and easily use the lever to perform the adjustment process, for example, during a break in plowing a roadway or during a snowplow maintenance process in a maintenance facility.

The adjustability of the spring bias force increases the versatility of the snowplow assembly by allowing it to match the requirements of a variety of roadway applications. For example, proper plow tripping forces are much different for gravel roads than for concrete roads. Furthermore, road obstructions on city streets, for example, at low speeds require a different setting than those on non-metro roads, for example, where the truck can travel at higher speeds. By adjusting the spring bias force, and thus the corresponding trip edge resistance, the snowplow assembly of the present invention can be adapted for varying roadway and environmental conditions.

The features of the present invention will become apparent to one of ordinary skill in the art upon reading the detailed description, in conjunction with the accompanying drawings, provided herein.

DETAILED DESCRIPTION OF EMBODIMENTS OF THE INVENTION

In accordance with the teachings of the present invention, there is provided a plow assembly for mounting to a vehicle, the plow assembly including an adjustable bias trip mechanism for allowing the plow assembly to "trip," or move, in response to encountering an obstruction. The trip mechanism includes a biasing member preferably in the form of a spring. The spring can be cooperatively arranged with a retainer, such as, a pin for example, at one or more retaining positions to impart a preload biasing force upon the spring which varies according to the retaining position selected. The preload biasing force can act as a trip resistance force which must be overcome before the plow assembly trips.

Figures 1, 5:
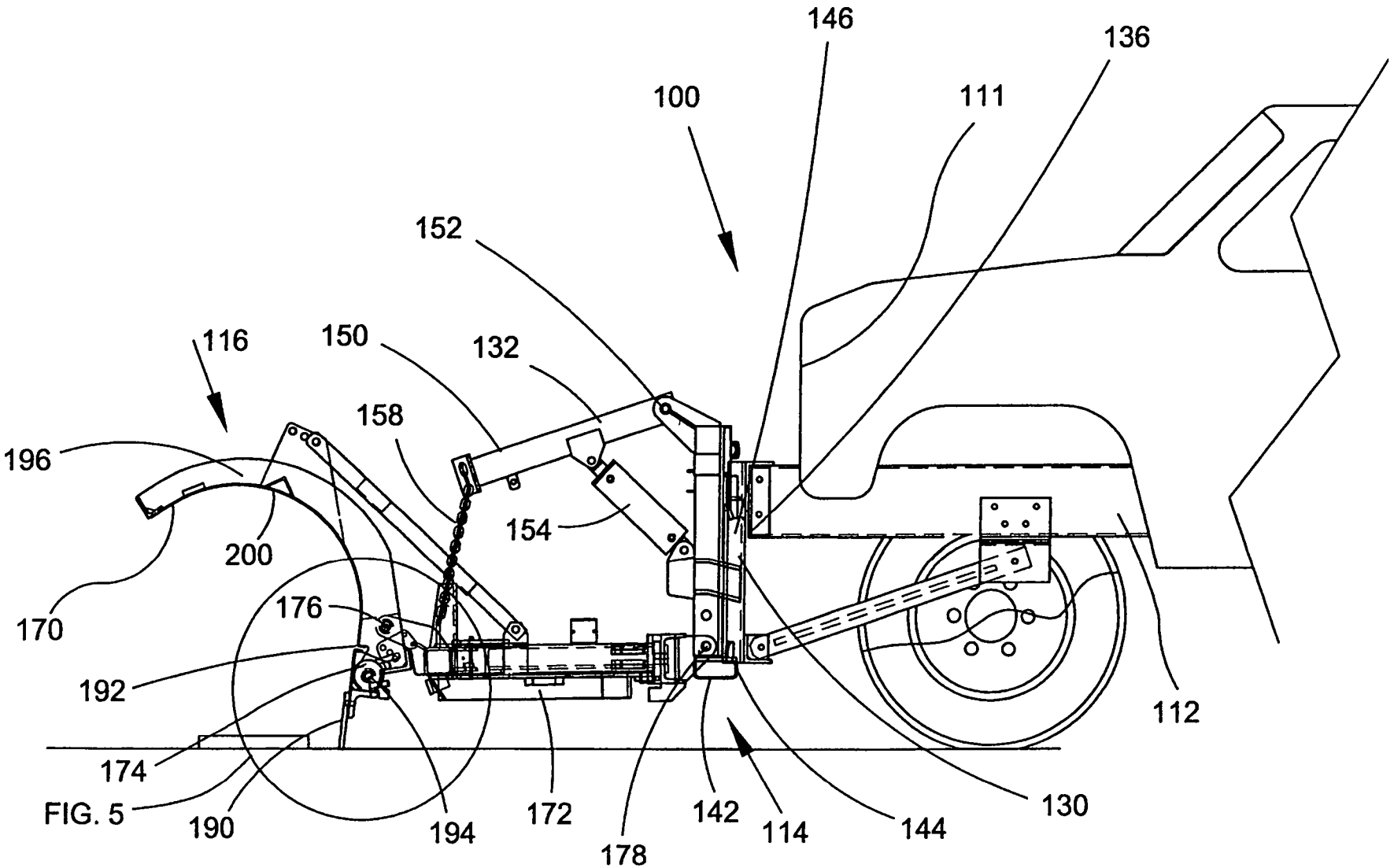
FIG. 1 is a side elevational view of an embodiment of a vehicle including a plow assembly having an adjustable trip mechanism in accordance with the present invention.
FIG. 5 is an enlarged, detail view taken from FIG. 1, illustrating a cutting edge of the plow assembly in a normal position encountering an obstruction.

Turning now to the Figures, an illustrative vehicle 100, including a front end 111, a chassis 112, a hitch assembly 114, and a plow assembly 116 is shown in FIG. 1. The hitch assembly 114 can be mounted to the chassis 112 at the front end 111 of the body 110. The plow assembly 116 can be supported by the hitch assembly 114. The plow assembly 116 can be pivotally mounted to the hitch assembly 114.

To removably mount the plow assembly 116 to the vehicle 100, the hitch assembly 114 is provided, part of which is secured to the chassis 112 and part of which is secured to the plow assembly 116. The hitch assembly 114 can be disposed between the plow assembly 116 and the chassis 112 for mounting the plow assembly to the chassis. The hitch assembly 114 can include a vehicle portion 130 and a plow portion 132, which is preferably removably mountable to the vehicle portion 130. To eliminate the danger posed by protrusions extending from the chassis 112 of the vehicle 100 when the plow 116 is unhitched, the vehicle portion 130 can includes a substantially planar mating surface which can be offset from the chassis 112 of the vehicle 100.

The vehicle portion 130 can be mounted to the chassis 112. The vehicle portion 130 can include a mounting member 136 in the form of a mounting plate that has a substantially planar face. The mounting member 136 defines a distal end having a flat surface which can extend from the front end 111 of the vehicle 100. The plow portion 132 can be provided to support the plow 116. The plow portion 132 can include a frame 140 and a movable member 142 which can be movable with respect to the frame 140. The movable member 142 can have a clamping member 144 which is adjustable to engage the mounting member 136 of the vehicle portion 130 for removably mounting the plow portion 132 thereto. The frame 140 of the plow portion can include a stationary clamping member 146 which can be cooperatively arranged with the clamping member 144 disposed on the movable member 142 to retentively engage the mounting member 136 of the vehicle portion 130.

The plow portion 132 of the hitch assembly 114 can include a lift arm 150 pivotally mounted to the frame 140 at a lift arm pivot 152. A lift cylinder 154 can extend between the frame 140 and the lift arm 152 for selectively moving the lift arm 150 about the lift arm pivot 152 with respect to the frame 140. The plow assembly 116 can be supported by the lift arm 150 with a support in the form of a pair of chains 158, for example, extending therebetween. The lift arm 150 can be operable to move the plow assembly 116 with respect to the hitch assembly 114.

It will be understood that in other embodiments, the hitch assembly can be different. Other suitable hitch assemblies include "pin hitches," "quick hitches," and "pin and loop hitches," for example.

The snowplow assembly 116 can include a snowplow blade or moldboard 170, a plow frame 172, and an adjustable trip mechanism 174. The moldboard 170 can be pivotally mounted to the plow frame 172 at a moldboard pivot 176. The plow frame 172, in turn, can be pivotally mounted to the hitch assembly 114 at a plow frame pivot 178. The adjustable trip mechanism 174 can be mounted to the moldboard 170.

Figure 2:
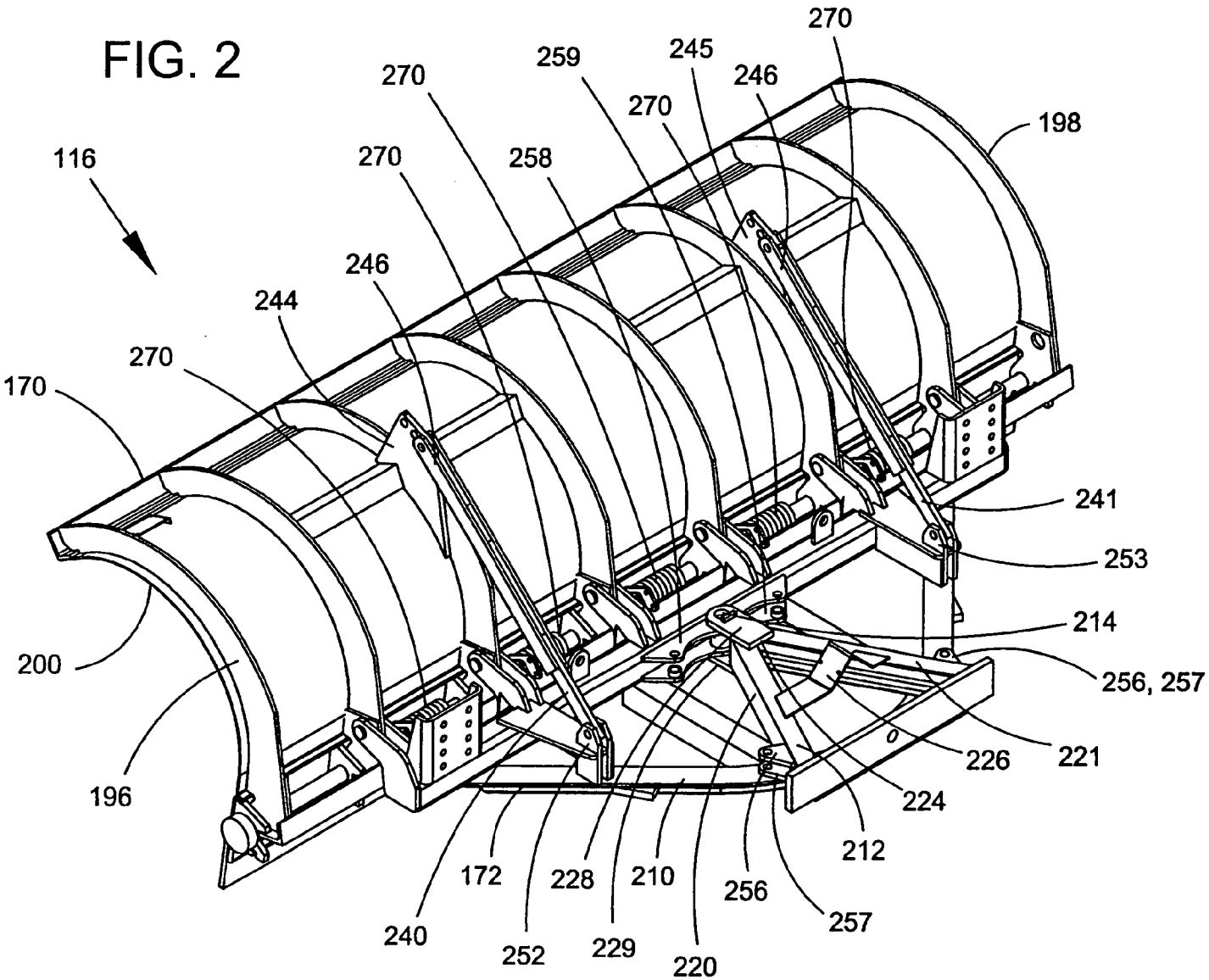
FIG. 2 is a rear perspective view of the plow assembly of FIG. 1.

The moldboard 170 can be provided for removing snow and/or ice or other materials from a surface, for example. The moldboard 170 can include a pivotally movable cutting edge 190 at a lower end 192 thereof. The moldboard 170 in FIG. 1 is a front-mounted moldboard which is mounted to the front 111 of the vehicle 100. The cutting edge 190 is pivotally movable about a cutting edge pivot 194. Referring to FIGS. 1 and 2, the moldboard 170 includes a first end 196, a second end 198, and a plowing surface profile 200. The profile 200 can be substantially the same between the first and second ends 196, 198. In other embodiments, the profile can vary between the ends, such as, a "one-way" front-mounted moldboard or a moldboard having flared ends or a V-shape, for example.

Figure 3:
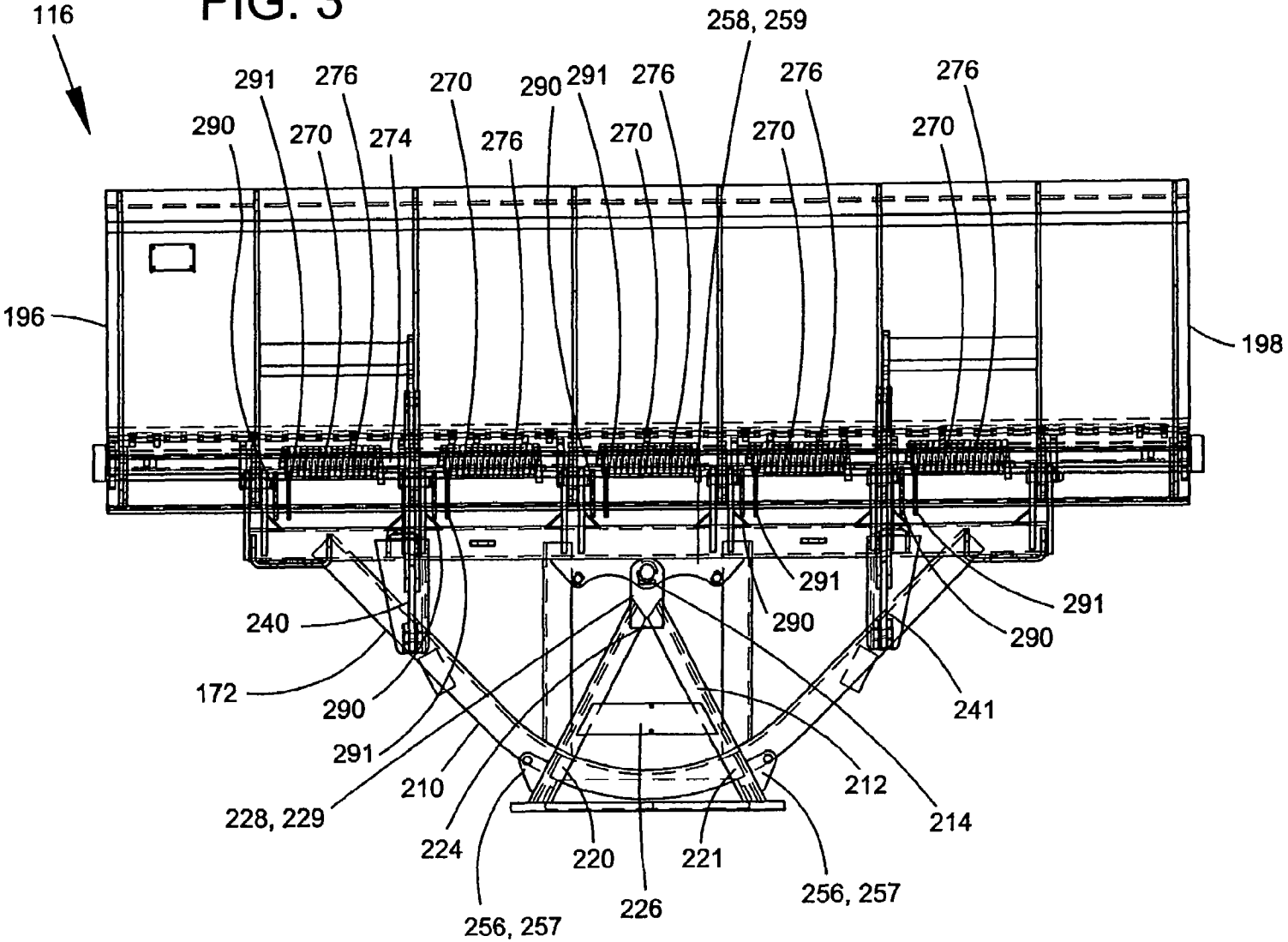
FIG. 3 is a top plan view of the plow assembly of FIG. 2.

Referring to FIG. 1, the chains 158 connect the plow frame 172 to the lift arm 150 for pivotal movement of the plow frame 172 upon movement of the lift arm. Referring to FIGS. 2 and 3, the plow frame 172 preferably includes a first frame component or push frame 210 and a second frame component or A-frame 212. The push frame 210 can be pivotally mounted at a push frame pivot 214 to the A-frame 212. The push frame 210 can be mounted to the moldboard 170, and the A-frame 212 can be mounted to the hitch assembly. The A-frame 212 is an A-shaped member having a pair of legs 220, 221 connected at an apex 224. The A-frame 212 can include a cross-brace 226 extending between the legs 220, 221. A pair of flanges 228, 229 extends from the apex 224 for pivotally mounting the push frame 210 to the A-frame 212 at the push frame pivot 214.

The plow assembly 116 can include a pair of adjustable braces 240, 241 extending between the push frame 210 of the plow frame 172 and the moldboard 170. The braces 240, 241 can be adjustable to pivot the moldboard 170 with respect to the plow frame 172 about the moldboard pivot 176. The braces 240, 241 can be adjustable to selectively position the moldboard 170 with respect to the plow frame 172.

Figure 4:
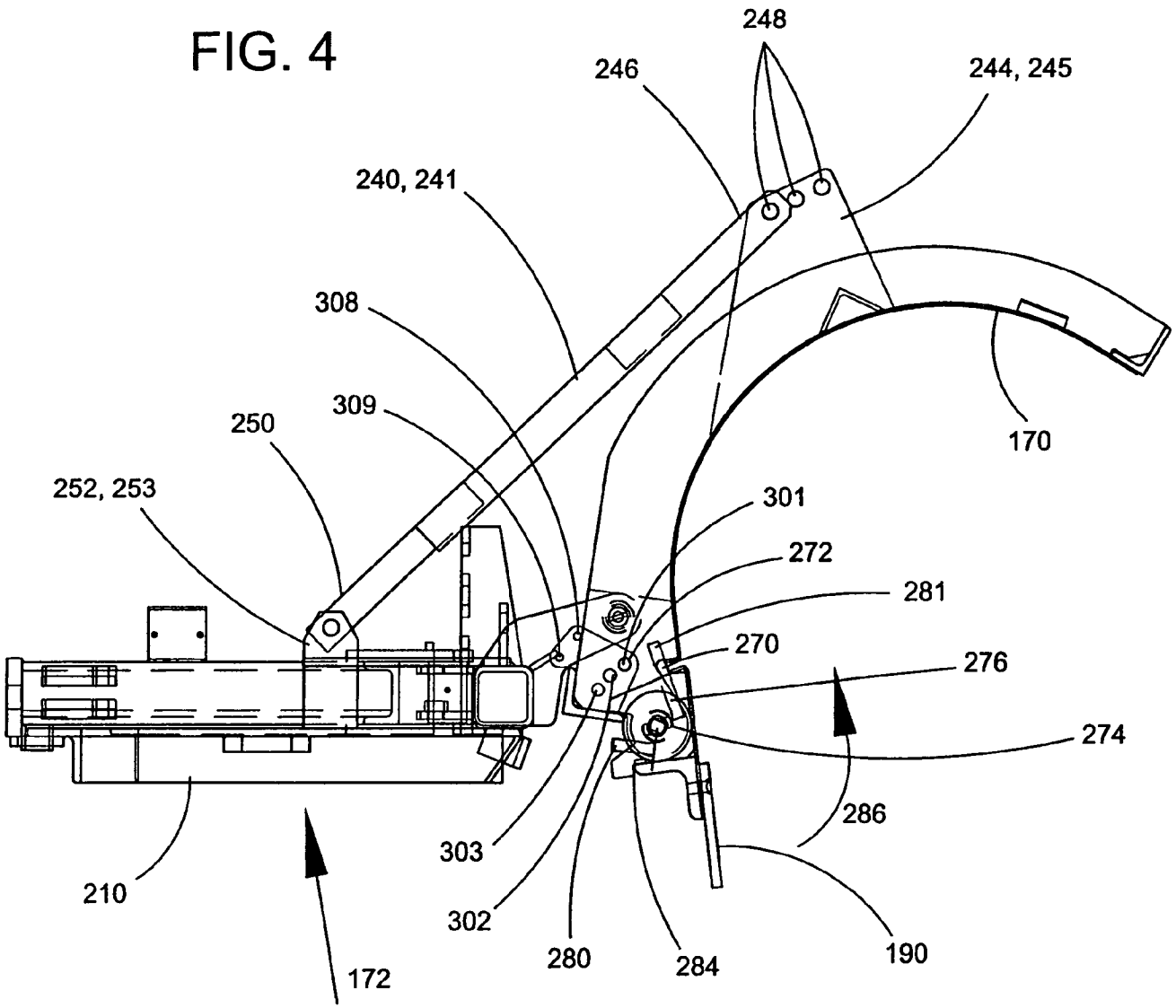
FIG. 4 is a side elevational view of the plow assembly of FIG. 2.

Referring to FIG. 2, the moldboard 170 includes a pair of mounting flanges 244, 245 extending therefrom for respectively receiving a distal end 246 of each brace. Referring to FIG. 4, each mounting flange 244, 245 includes a plurality of mounting holes 248 for respectively pinning the distal end 246 of the brace 240, 241 to the mounting flange 244, 245. In the illustrative embodiment, there are three such mounting holes to provide for different mounting options for the braces. Referring to FIG. 2, a proximal end 250 of each brace 240, 241 can be mounted to a mounting bracket 252, 253 projecting from the push frame 210 of the plow frame 172.

Referring to FIGS. 2 and 3, a pair of plow cylinders can be provided to pivot the push frame 210 and the moldboard 170 with respect to the A-frame 212 about the push frame pivot 214. The plow cylinders can flank the A-frame 212, extending between a pair of mounting plates 256, 257 respectively extending from each leg 220, 221 of the A-frame 212 and a pair of mounting brackets 258, 259 extending from the push frame 210. The plow cylinders can be selectively moved to rotate the moldboard 170 and the push frame 210 about the push frame pivot 214 to allow the moldboard 170 to be disposed at a desired angle with respect to the longitudinal axis of the vehicle.

The precise configuration of the push frame 210 can vary according to the type of vehicle onto which the assembly is to be mounted (e.g., tractor or light-duty or heavy-duty truck). In other embodiments, the plow frame can comprise a single component.

Referring to FIG. 1, for biasing the cutting edge 190 of the moldboard 170 to a normal, plowing position and for providing the cutting edge 190 with an adjustable trip edge resistance, the trip mechanism 174 is provided. The trip mechanism 174 is preferably mounted to the moldboard 170 for biasing the cutting edge 190 of the moldboard 170 to a normal, plowing position by urging the cutting edge 190 to the plow position with a trip edge resistance force. The trip mechanism 174 can allow the cutting edge 190 of the moldboard 170 to "trip," or pivotally move, from the normal, plowing position to a displaced position when the plow encounters a rigid obstruction, such as a manhole cover or curb, for example, which overcomes the trip edge resistance.

Referring to FIG. 4, the trip mechanism 174 preferably includes at least one suitable compressible biasing member, such as a coil spring 270, and a retainer, such as, a pin 272, for example, associated with each biasing member 270. Referring to FIG. 2, the illustrative embodiment includes five springs 270. The retainer can be selectively arrangeable with each biasing member 270 at each of at least one retaining position to impart a biasing force upon the biasing member, the biasing force varying according to the retaining position selected.

Referring to FIGS. 3 and 4, each spring 270 can be axially mounted to a mounting shaft 274 extending through a coil portion 276 of the spring. Referring to FIG. 3, in the illustrative embodiment, the five springs 270 are mounted to the mounting shaft 274. The mounting shaft 274 can extend between the first and second ends 196, 198 of the moldboard 170. Referring to FIG. 4, each spring 270 includes a first tail end 280 and a second tail end 281 extending from the coil portion 276. Each spring 270 can be mounted to the mounting shaft 274 such that the spring 270 is in an unloaded, normal position, as shown in FIG. 4. The first tail end 280 can engage a ledge 284 of the cutting edge 190 of the moldboard 170. In particular, the first tail end 280 of the spring can contact the ledge 284 which in turn can prevent further movement of the first tail end 280 of the spring 270 in a direction indicated by an arrow 286 in FIG. 4.

Referring to FIGS. 3 and 4, the second tail end 281 of each spring 270 can be disposed between a pair of retaining plates 290, 291 having a plurality of retaining holes 301, 302, 303 therein for defining a corresponding plurality of spring retaining positions. The pair of retaining plates 290, 291 can be associated with each biasing member 270. Referring to FIG. 4, the plurality of retaining holes 301, 302, 303 in turn defines a corresponding plurality of retaining positions. In the illustrative embodiment, the plates each include three retaining holes 301, 302, 303 which correspond to the retaining holes of the retaining plate to which it is mated.

Figure 9:
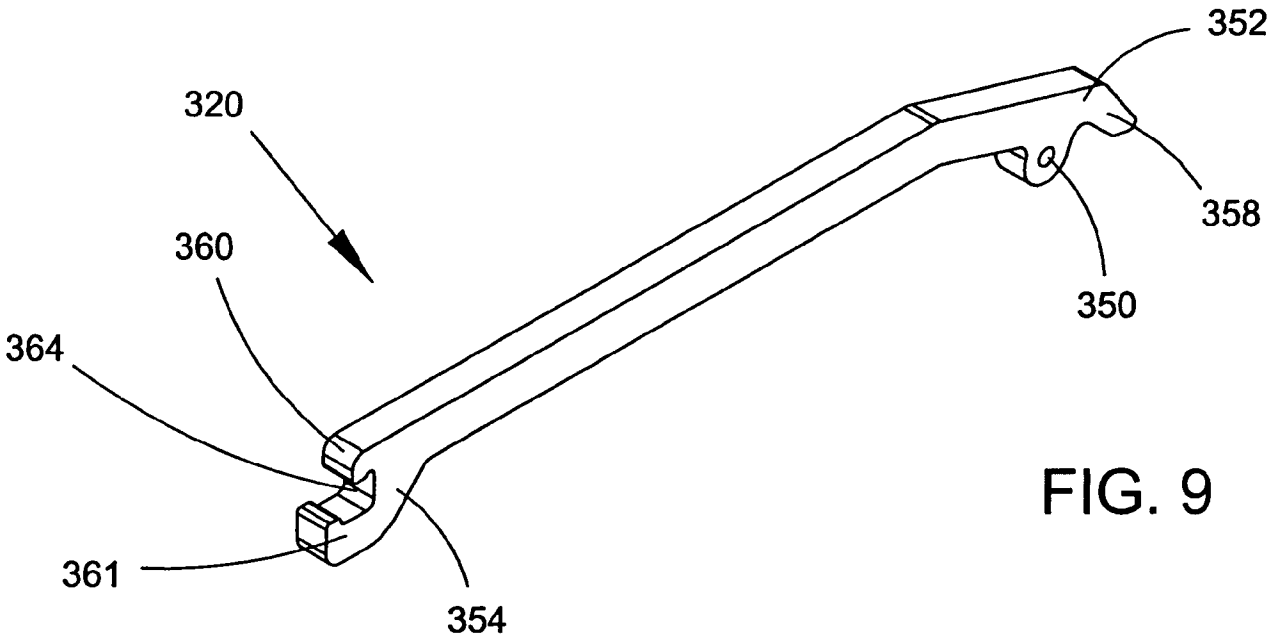
FIG. 9 is a perspective view of a lever tool useful in connection with the adjustable trip mechanism of the present invention.
Figure 10:
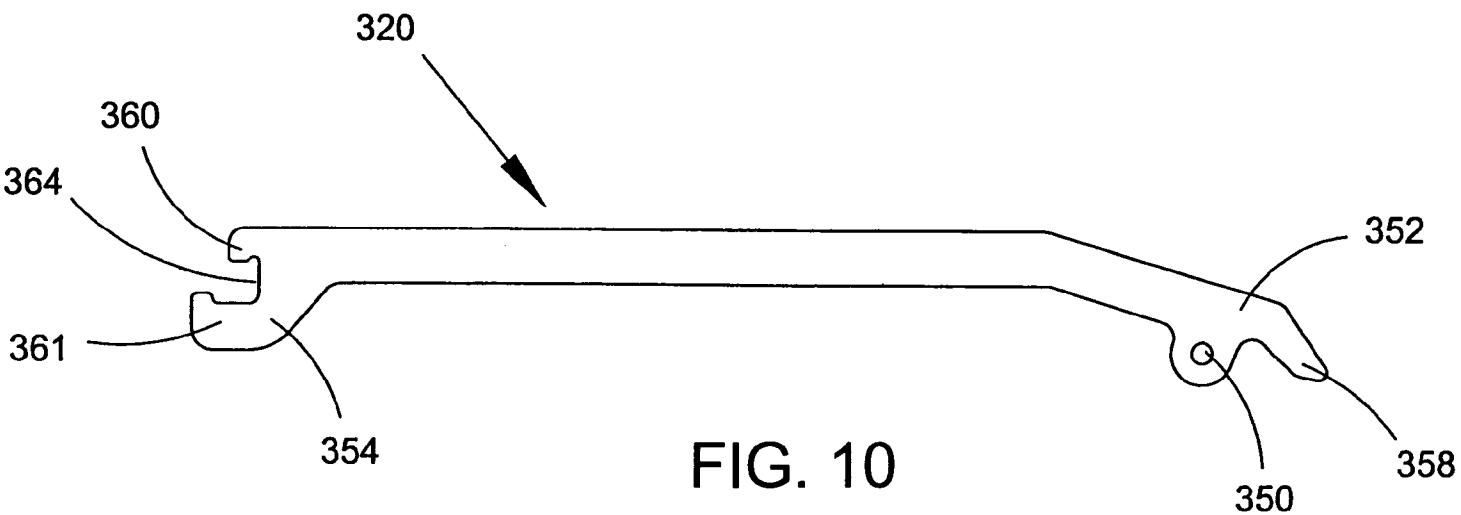
FIG. 10 is a side elevational view of the lever tool of FIG. 9.

At least one of the pair of mating retaining plates includes a pair of positioning lugs 308, 309 for cooperative arrangement with a lever tool 320, shown in FIGS. 9 and 10, to facilitate in the positioning of the second tail end 281 of the spring with respect to the retaining positions 301, 302, 303.

The retainer 272 can be provided for selectively adjusting the position of the second tail end 281 of the spring for imparting a variable pre-load spring force therein.

The retainer 272 can comprise a pin, as shown in FIG. 5. The pin 272 can be engaged with the pair of retaining plates 290, 291 associated with each spring 270 at a selected pair of retaining holes, in this case the second retaining holes 302, to retain the second tail end of the spring in the selected retaining position, in this case the second retaining position. The pin 272 can be selectively arrangeable with the spring at each of the retaining positions to impart a corresponding biasing force upon the spring. The biasing force can vary according to the retaining position selected. In the illustrative embodiment, the second retaining position 302 imparts a greater biasing force than the first retaining position 301. The third retaining position 303 imparts a greater biasing force than the second retaining position 303.

Figure 6:
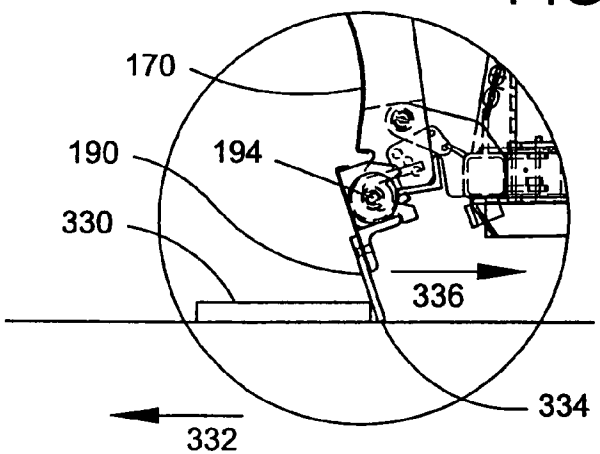
FIG. 6 is a view similar to FIG. 5, illustrating the cutting edge displaced to a tripped position.
Figure 5:
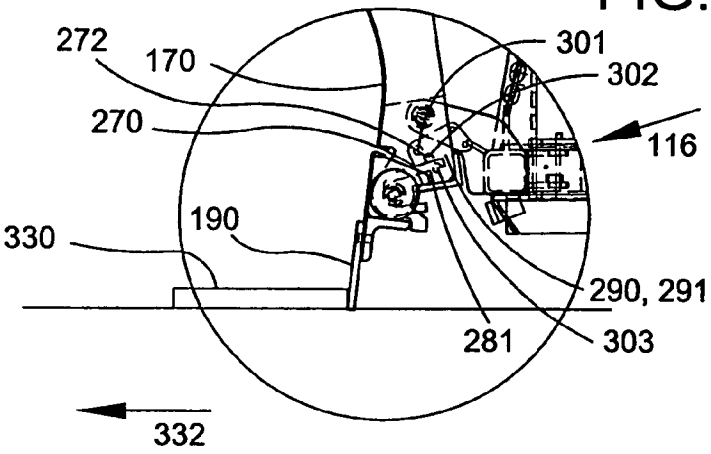

Referring to FIGS. 5-8, a tripping sequence is shown. The tripping movement of the cutting edge 190 of the moldboard 170 can occur when cutting edge 190 of the moldboard 170 encounters an obstruction 330. Referring to FIG. 5, the plow assembly 116 is moving in a first direction 332. The cutting edge 190 is in a plowing position. The cutting edge 190 is engaged with the obstruction 330. Referring to FIG. 6, the cutting edge 190 has moved to a displaced position. A distal end 334 of the cutting edge 190 has moved in a second direction 336, opposing the first direction 332, with respect to the normal, plowing position of the cutting edge 190. The force generated by the cutting edge 190 striking the obstruction was sufficient to overcome the trip edge resistance. The cutting edge 190 pivoted about the cutting edge pivot 194 to the displaced position shown in FIG. 6. In the displaced position, the cutting edge 190 provides an incline surface which can permit the moldboard 170 to ride over the obstruction 330.

Figure 7:
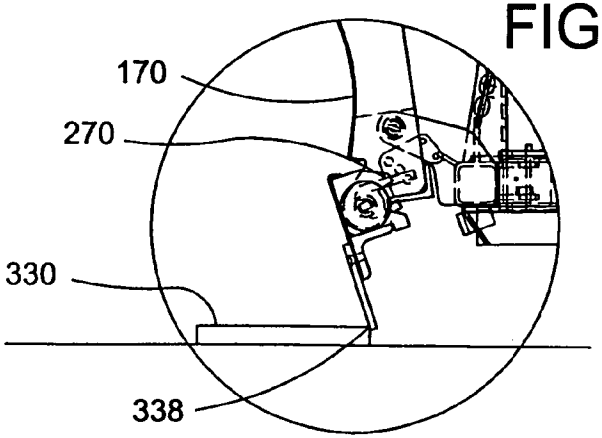
FIG. 7 is a view similar to FIG. 6, illustrating the cutting edge displaced to an elevated position to clear the obstruction.

Referring to FIG. 7, cutting edge 190 is disposed over an edge 338 of the obstruction 330 and is on a top surface thereof. The bias member 270 can act to return the cutting edge 190 to the plowing position.

Figure 8:
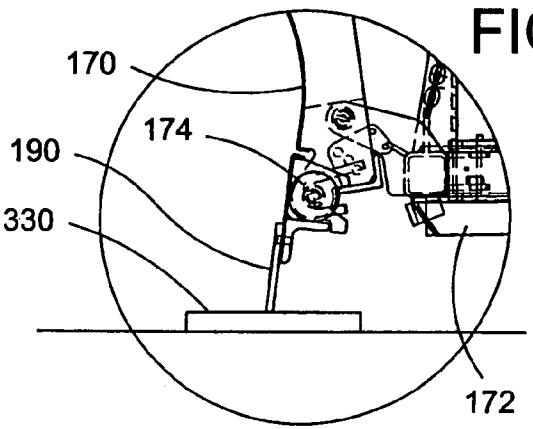
FIG. 8 is a view similar to FIG. 7, illustrating the cutting edge in a normal position atop the obstruction.

Referring to FIG. 8, the trip mechanism 174 has returned the cutting edge 190 to the normal, plowing position. The plow frame 172 and the moldboard 170 are in an elevated position with the plow frame 172 and the moldboard 170 having pivoted about the plow frame pivot. The tripping action of the cutting edge 190 and the ability of the moldboard 170 and the plow frame 172 to pivot in response to encountering an obstruction can reduce the force of the impact and, consequently, reduce the risk of damage to the assembly components, as well as to the vehicle and the driver/operator.

Referring to FIGS. 9 and 10, the lever tool 320 can be provided for selectively adjusting the biasing member with respect to the retaining positions. The lever tool 320 can be used to move each spring of the trip mechanism from the normal position to a desired retaining position to impart a preload force upon the respective spring corresponding to the selected retaining position.

The lever 320 includes a pivot recess 350, a pivot end 352, and a clamping end 354. The pivot recess 350 can be configured to pivotally engage each of the positioning lugs of the retaining plate. The pivot recess 350 can be adjacent the pivot end 352. The pivot end 352 includes a hooked finger 358 which can be configured to engage the second tail end of the spring when the lever tool 320 is pivotally engaged with one of the positioning lugs.

The tool 320 is configured to cooperate with each of the positioning lugs, which can act as a fulcrum for the tool 320, to move the second tail end of each spring to a selected one of a plurality of preload spring positions. The lever 320 can be engageable with the positioning lug such that the positioning lug defines a fulcrum for pivotal movement of the lever tool.

The clamping end 354 opposes the pivot end 352. The clamping end 354 includes a pair of spaced apart jaws 360, 361 that define a clamping recess 364. The jaws 360, 361 can be configured to engage the biasing member for movement thereof.

Referring to FIGS. 11-16, the biasing member 270 is shown undergoing an adjustment sequence wherein it is placed in each of the three retaining positions 301, 302, 303 by use of the lever tool 320.

In one method for biasing a movable cutting edge 190 of a moldboard of a plow assembly, the method includes mounting a spring to the mounting shaft of the moldboard. The spring can be mounted to the mounting shaft with the spring in a normal, unloaded position. The tail end of the spring can be arranged with respect to the retaining plate. The tail end of the spring can be disposed at a selected one of the retaining positions and secured by inserting the retaining pin at the selected retaining position, thereby imparting a biasing force upon the spring that corresponds to the retaining position selected. The position of the tail end of the spring can be adjusted to another selected retaining position.

The trip mechanism 174 is adjustable to exert a variable amount of biasing force upon the cutting edge 190 of the moldboard. More specifically, the degree of biasing force can be selectively adjusted by rotating the second tail end 281 of the spring 270 either toward or away from the first tail end 280.

Figure 12:
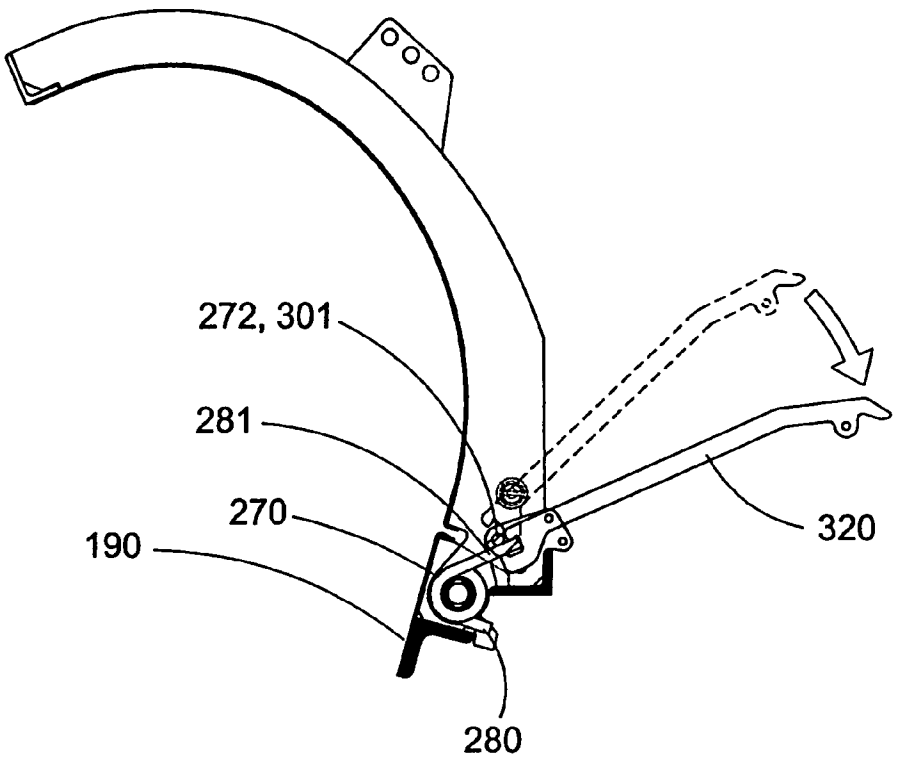
FIG. 12 is a side elevational view as in FIG. 11, illustrating the spring of the trip mechanism in the first preload position.
Figure 11:
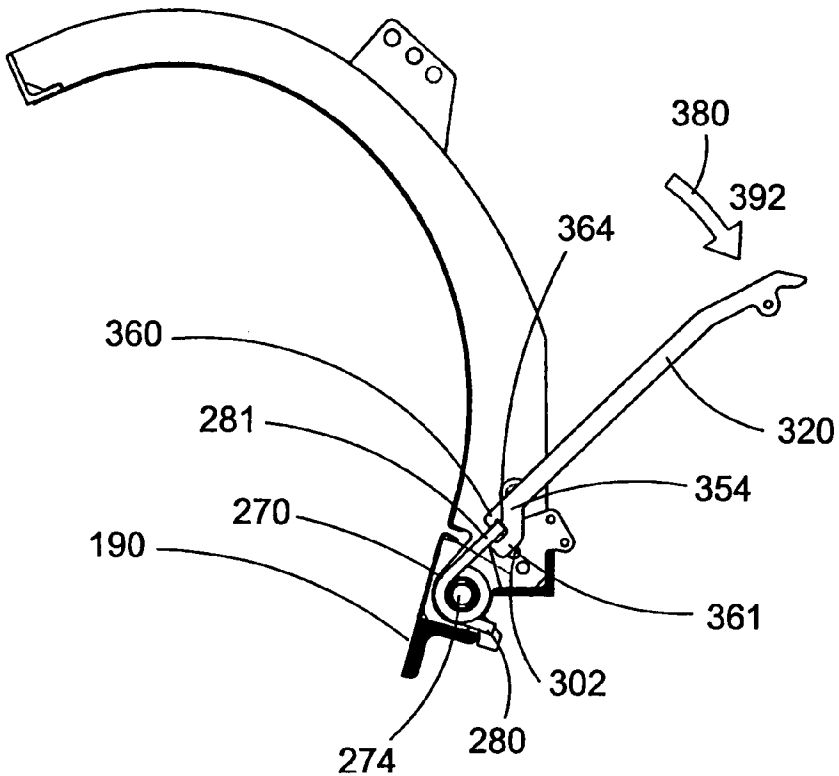
FIG. 11 is a side elevational view of a portion of the plow assembly of FIG. 2, illustrating a spring of the trip mechanism in a pre-mounted position and the lever engaged therewith to move the spring to a first preload position.

Referring to FIGS. 11 and 12, the bias member 270 is shown being positioned in the first retaining position 301. Referring to FIG. 11, the spring 270 is mounted to the mounting shaft 274 in an unloaded, normal position with no preload force imparted thereon. The clamping end 354 of the lever tool 320 is engaged with the second tail end 281 of the spring such that the tail end 281 is disposed in the clamping recess 364 between the clamping jaws 360, 361. The lever tool 320 can facilitate the movement of the second tail end 281 to the first retaining position 301. The lever tool 320 can act to increase the moment arm between an applied force 380 in a clockwise direction 392 and the mounting shaft 274 about which the second tail end 281 rotates.

The lever tool 320 can be moved to thereby move the second tail end 281 such that the second tail end 281 is disposed at the first retaining position 301. The retaining pin 272 can be inserted into the first retaining hole 301 to prevent the second tail end 281 from returning to the normal position and to retain the second tail end at the first retaining position 301, as shown in FIG. 12.

Figure 14:
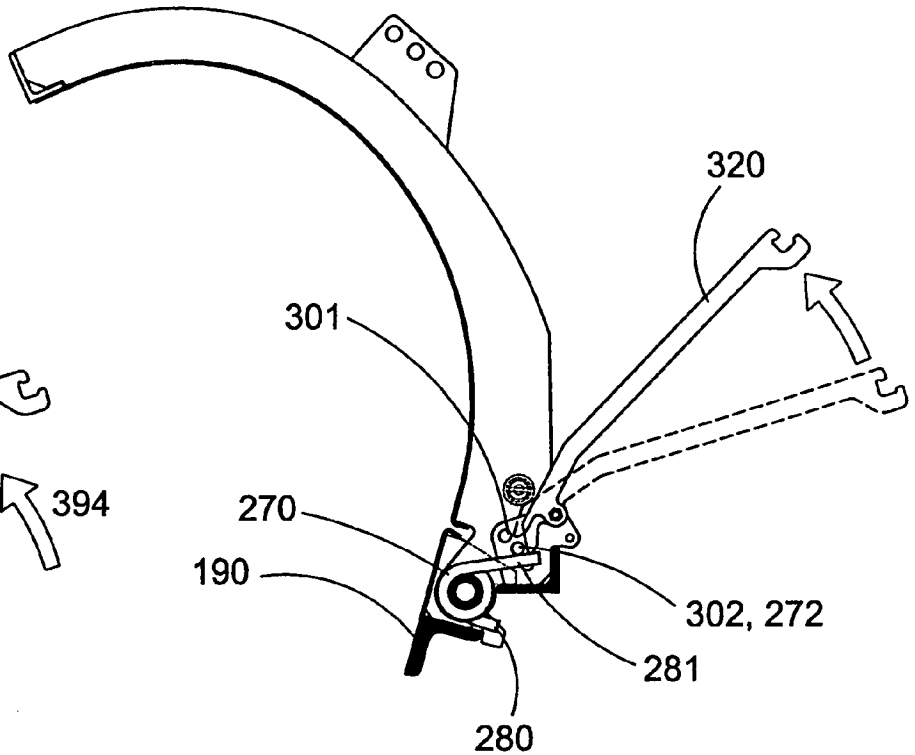
FIG. 14 is a side elevational view as in FIG. 13, illustrating the spring of the trip mechanism in the second preload position.
Figure 13:
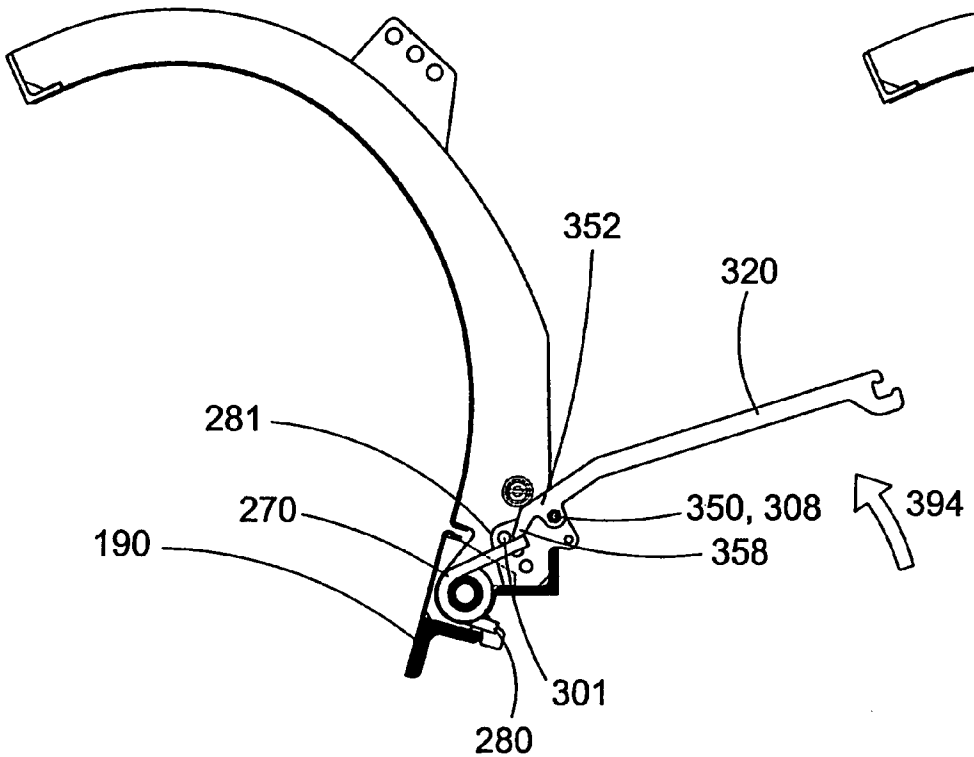
FIG. 13 is a side elevational view as in FIG. 12, illustrating the lever engaged with the spring of the trip mechanism to move the spring to a second preload position.

Referring to FIGS. 13 and 14, the bias member 270 is shown being adjusted to the second retaining position 302. Referring to FIG. 13, the second tail end 281 is disposed at the first retaining position 301. The retaining pin can be removed from the first retaining hole 301. The pivot recess 305 of the lever tool 320 is pivotally engaged with the first positioning lug 308. The hooked finger 358 of the pivot end 352 of the tool is engaged with the second tail end 281 of the spring 270. By rotating the tool 320 about the first positioning lug 308 in a counterclockwise direction 394, the pivot end 352 of the lever 320 can move the second tail end 281 of the spring to the second preload position 302, as shown in FIG. 14. In the second retaining position, the second tail end 281 of the spring can be retentively engaged by the retaining pin. The retaining pin can be inserted into the second retaining holes 302 to retain the second tail end 281 of the spring in the second retaining position 302. The second retaining position 302 imparts a greater trip resistance upon the cutting edge 190 of the moldboard than the first retaining position 301.

Figure 16:
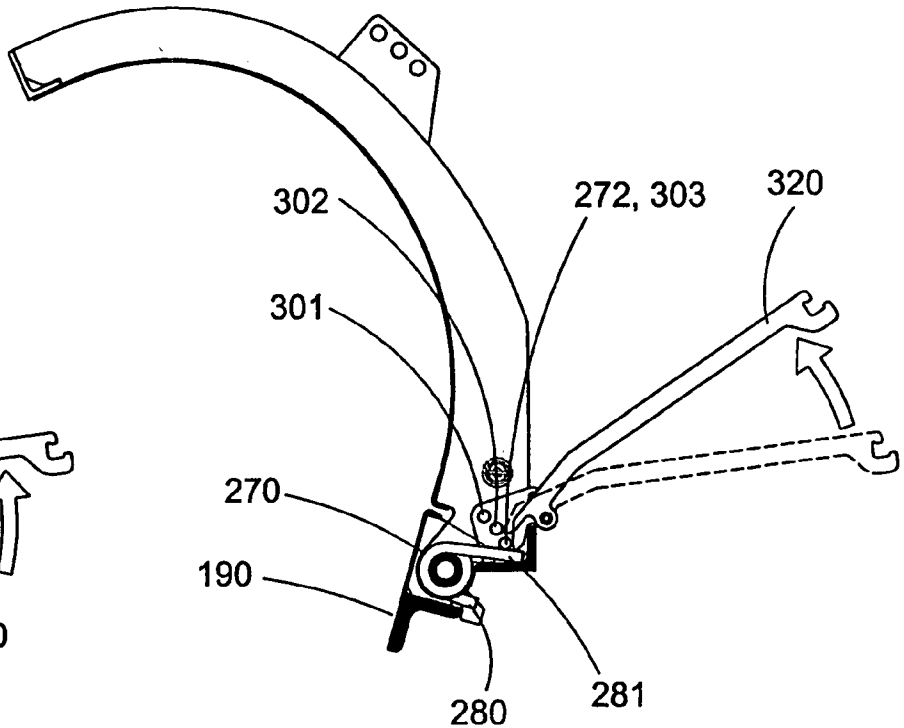
FIG. 16 is a side elevational view as in FIG. 15, illustrating the spring of the trip mechanism in the third preload position.
Figure 15:
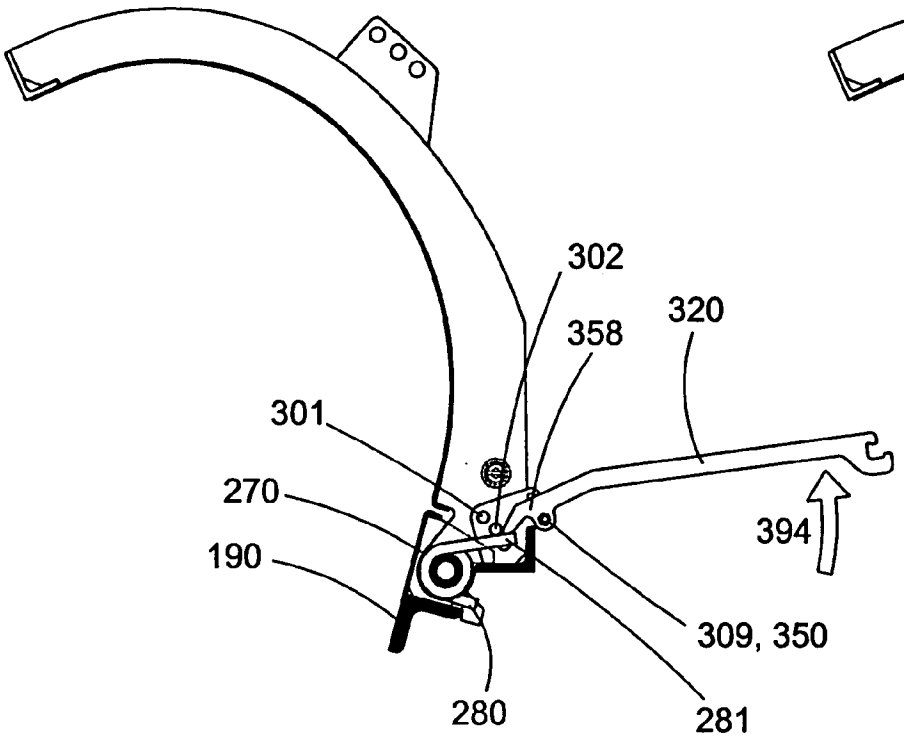
FIG. 15 is a side elevational view as in FIG. 14, illustrating the lever engaged with the spring of the trip mechanism to move the spring to a third preload position.

Referring to FIGS. 15 and 16, the pivot recess of the lever tool 320 can be rotatably engaged with the second positioning lug 309. By rotating the tool 320 about the second positioning lug 309 in the counterclockwise direction 394, the hooked finger 358 of the tool 320 can move the second tail end 281 of the spring 270 to a third retaining position 303, as shown in FIG. 16. In the third retaining position 303, the retaining pin 272 can retentively engage the second tail end 281 of the spring 270. The retaining pin 272 can be inserted into the third retaining holes 303 to retain the second tail end of the spring in the third retaining position 303. The third retaining position 303 imparts a greater trip resistance upon the cutting edge 190 of the moldboard than the second preload position 302.

Rotation of the second tail end 281 of the spring 270 relative to the first tail end 280 can allow for the second end 281 to be retained at a correspondingly different retaining position by the retaining pin. Because each such retaining position is associated with a particular amount of distance between the first and second tail ends 280, 281 (and thus a particular amount of spring compression), the amount of predetermined spring preload force may be readily varied depending on the retaining position selected.

Figure 17:
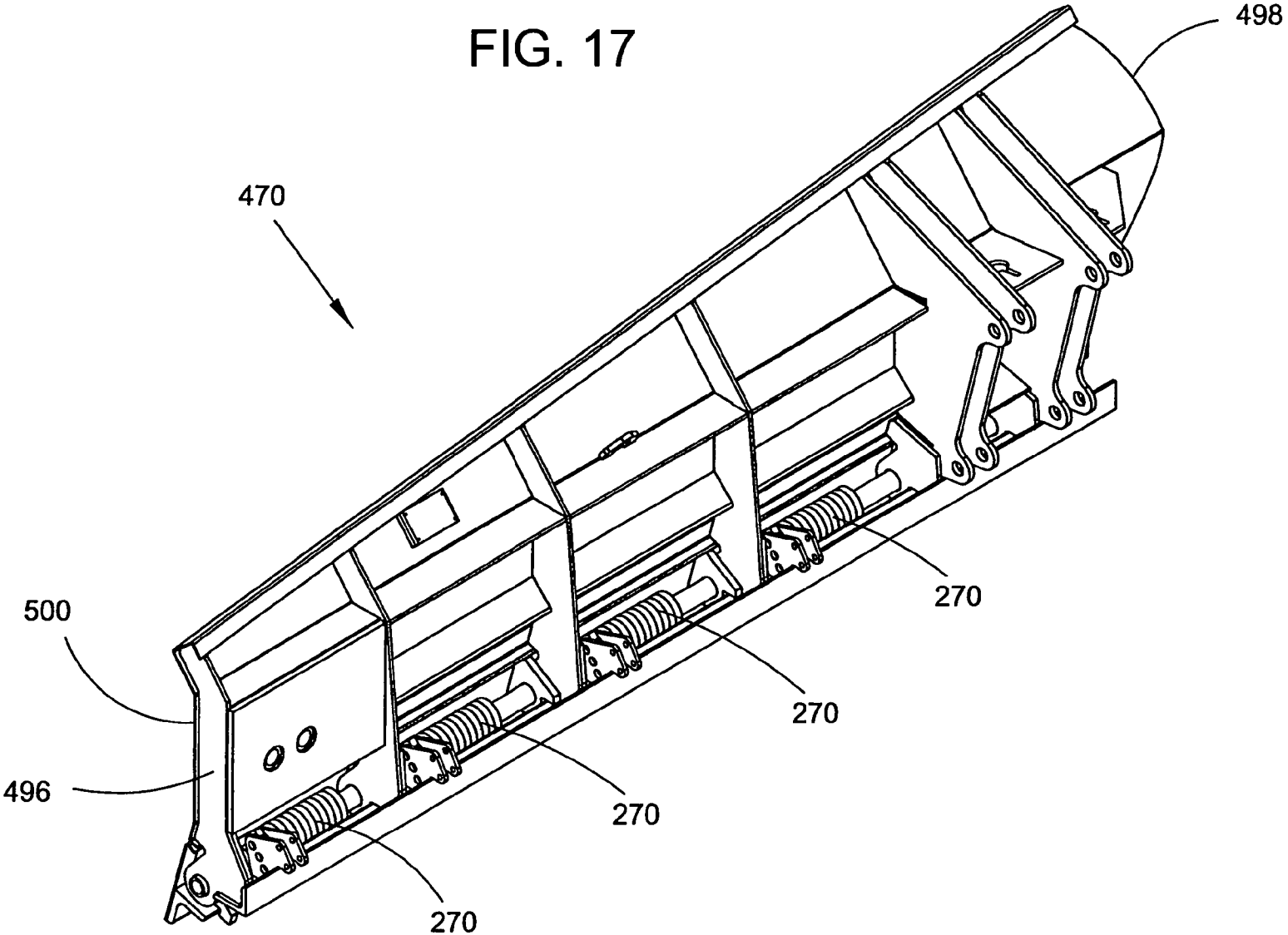
FIG. 17 is a perspective view of another embodiment of a moldboard having an adjustable trip mechanism in accordance with the present invention mounted thereto.

Referring to FIG. 17, another embodiment of a moldboard 470 useful in connection with the present invention is shown. The moldboard 470 in FIG. 17 is a side-mounted moldboard, a "wing" moldboard, which can be mounted to one of the sides of the vehicle. The illustrative moldboard is a "benching wing" moldboard. In other embodiments, the moldboard 470 can be a "patrol wing" moldboard, a "leveling wing" moldboard, or a "mid-mount wing" moldboard, for example. The moldboard 470 includes a first end 496, a second end 498, and a profile 500. The profile 500 changes between the first and second ends 496, 498 with the first end 496 being smaller than the second end 498. In other embodiments, the wing moldboard can have a profile that can be substantially the same between the first and second ends.

The moldboard 470 can include an adjustable bias trip mechanism according to the present invention. The illustrative benching wing plow 470 includes four bias members 270 in the form of springs. The benching wing 470 can be similar in construction and operation in other respects to the moldboard shown in FIG. 1.

A plurality of retaining pins can be used in the system. It will be understood that the number of different preload positions, and the resulting preload forces imparted upon the spring 270, can be varied by changing the number and/or configuration of the retaining positions in other embodiments.

In other embodiments the number of bias members can be varied. Where multiple springs are provided, each spring can be independently adjusted to impart a variable preload force upon each spring. Thus, the springs can be adjusted to have different preload forces with respect to each other, thereby providing increased adjustability.

The availability of a relatively readily adjustable biasing force is of significant advantage to a vehicle operator. For example, the operator, after leaving a garage, may adjust the biasing force to compensate for a variety of surface conditions (e.g., gravel versus paved roadways), and changes in environmental conditions (increases in snowfall, and density of snow) quickly and, further, without having to disassemble the assembly or return to the garage for assistance.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise indicated.

While the invention is described herein in connection with certain preferred embodiments, there is no intent to limit the present invention to those embodiments. On the contrary, it is recognized that various changes and modifications to the described embodiments will be apparent to those skilled in the art upon reading the foregoing description, and that such changes and modifications may be made without departing from the spirit and scope of the present invention. The inventors expect skilled artisans to employ such variations as appropriate, and the inventors intend for the invention to be practiced otherwise than as specifically described herein. Accordingly, the intent is to cover all alternatives, modifications, and equivalents included within the spirit and scope of the invention. Moreover, any combination of the above-described elements in all possible variations thereof is encompassed by the invention unless otherwise indicated herein or otherwise clearly contradicted by context.

What is claimed is:

1. A plow assembly comprising:

a moldboard the moldboard includes a movable cutting edge;

a plow frame, the moldboard pivotally mounted to the plow frame; and an adjustable bias mechanism, the biasing mechanism arranged with the cutting edge to bias the cutting edge to a plowing position, the adjustable bias mechanism including a spring, a retaining plate, and a retainer, the retaining plate including a plurality of retaining holes defining a corresponding plurality of retaining positions, the retainer being insertable into each of the retaining holes, the retainer being selectively arrangeable with the spring at each of the retaining positions to impart a corresponding biasing force upon the spring, the biasing force varying according to the retaining position selected.

2. A vehicle comprising:

a chassis having a front end; and a plow assembly mounted to the front end of the chassis, the plow assembly including a moldboard and an adjustable bias mechanism, the bias mechanism including a biasing member, a retainer, and at least one retaining position, the retainer being selectively arrangeable with the biasing member at each of the at least one retaining position to impart a biasing force upon the biasing member, the biasing force varying according to the retaining position selected;

wherein the moldboard includes a movable cutting edge, the bias mechanism arranged with the cutting edge to bias the cutting edge to a plowing position.

3. The vehicle according to claim 2 further comprising:

a hitch assembly disposed between the plow assembly and the chassis for mounting the plow assembly to the chassis.

4. The vehicle according to claim 3 wherein the hitch assembly includes a mounting member mounted to the chassis adjacent the front end of the chassis, the mounting member including a substantially planar face, and the hitch assembly includes a frame for supporting the plow assembly, the frame removably mounted to the mounting member.

5. The vehicle according to claim 3 wherein the plow assembly includes a plow frame, the moldboard pivotally mounted to the plow frame, the plow frame pivotally mounted to the hitch assembly.

6. The vehicle according to claim 5 wherein the hitch assembly includes a lift arm for moving the plow frame with respect to the hitch assembly, the lift arm connected to the plow frame.

7. The vehicle according to claim 6 wherein a support connects the lift arm to the plow frame.

8. The vehicle according to claim 7 wherein the support comprises a chain.

9. The vehicle according to claim 5 wherein the plow assembly includes an adjustable brace extending between the mold board and the plow frame, the brace being adjustable to pivot the moldboard with respect to the plow frame.

10. The vehicle according to claim 2 wherein the biasing member comprises a spring, the spring including a first tail end and a second tail end, the first tail end engageable with the cutting edge, and the second tail end being engageable with the retainer.

11. A method for biasing a movable cutting edge of a moldboard of a plow assembly, the method comprising:

mounting a spring to the moldboard, the spring including a first tail end and a second tail end;

engaging the first tail end with the cutting edge;

arranging the second tail end of the spring with respect to a retaining plate, the retaining plate including a plurality of retaining holes defining a corresponding plurality of retaining positions;

disposing the second tail end of the spring at a selected one of the retaining positions;

securing the second tail end at the selected retaining position;

wherein the spring is imparted with a biasing force that varies according to the retaining position selected, the biasing force being exerted against the cutting edge of the moldboard.

12. The method according to claim 11 wherein the moldboard includes a mounting shaft, the spring being mounted to the mounting shaft.

13. The method according to claim 12 wherein the spring is mounted to the mounting shaft with the spring in a normal, unloaded position.

14. The method according to claim 11 wherein the second tail end is secured to the selected retaining position by a retainer.

15. The method according to claim 14 wherein the retainer comprises a pin that is insertable into each of the retaining holes.

16. The method according to claim 11 wherein the second tail end of the spring is disposed at a selected one of the retaining positions by a lever.

17. The method according to claim 11 further comprising:

adjusting the position of the second tail end of the spring to another selected retaining position.

18. A vehicle comprising:

a chassis having a front end; and a plow assembly mourned to the front end of the chassis, the plow assembly including a moldboard and an adjustable bias mechanism, the bias mechanism including a biasing member, a retainer, and at least one retaining position, the retainer being selectively arrangeable with the biasing member at each of the at least one retaining position to impart a biasing force upon the biasing member, the biasing force varying according to The retaining position selected;

a hitch assembly disposed between the plow assembly and the chassis for mounting the plow assembly to the chassis;

wherein the plow assembly includes a plow frame, the moldboard pivotally mounted to the plow frame, the plow frame pivotally mounted to the hitch assembly; and wherein the hitch assembly includes a lift arm for moving the plow frame with respect to the hitch assembly, the lift arm connected to the plow frame.

19. The vehicle according to claim 18 wherein the hitch assembly includes a mounting member mounted to the chassis adjacent the front end of the body, the mounting member including a substantially planar face, and the hitch assembly includes a frame for supporting the plow assembly, the frame removably mounted to the mounting member.

20. The vehicle according to claim 18 wherein a support connects the lift arm to the plow frame.

21. The vehicle according to claim 20 wherein the support comprises a chain.

22. A vehicle comprising:

a chassis having a front end; and a plow assembly mounted to the front end of the chassis, the plow assembly including a moldboard and an adjustable bias mechanism, the bias mechanism including a biasing member, a retainer, and at least one retaining position, the retainer being selectively arrangeable with the biasing member at each of the at least one retaining position to impart a biasing force upon the biasing member, the biasing force varying according to the retaining position selected;

a hitch assembly disposed between the plow assembly and the chassis for mounting the plow assembly to the chassis;

wherein the plow assembly includes a plow frame, the moldboard pivotally mounted to the plow frame, the plow frame pivotally mounted to the hitch assembly;

wherein the plow assembly includes an adjustable brace extending between the mold board and the plow frame, the brace being adjustable to pivot the moldboard with respect to the plow frame.

* * * * *

UNITED STATES PATENT AND TRADEMARK OFFICE

CERTIFICATE OF CORRECTION

PATENT NO. : 7,263,789 B2
APPLICATION NO. : 11/039669
DATED : September 4, 2007
INVENTOR(S) : Hollinrake et al.

It is certified that error appears in the above-identified patent and that said Letters Patent is hereby corrected as shown below:

IN THE CLAIMS:

Column 12, Line 42: "to The retaining" should read -- to the retaining --.

Column 12, Line 67: "adjustable bias-mechanism" should read -- adjustable bias mechanism --.

Signed and Sealed this

Eighteenth Day of December, 2007

JON W. DUDAS
*Director of the United States Patent and Trademark Office*